US008342243B2

(12) United States Patent
Esmail

(10) Patent No.: US 8,342,243 B2
(45) Date of Patent: Jan. 1, 2013

(54) METHOD FOR STAGE-CEMENTING AN OIL WELL

(75) Inventor: Omar Jubran Esmail, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 304 days.

(21) Appl. No.: 12/448,544

(22) PCT Filed: Nov. 15, 2007

(86) PCT No.: PCT/US2007/024106
§ 371 (c)(1),
(2), (4) Date: Jun. 23, 2009

(87) PCT Pub. No.: WO2008/069914
PCT Pub. Date: Jun. 12, 2008

(65) Prior Publication Data

US 2010/0084135 A1 Apr. 8, 2010

(51) Int. Cl.
*E21B 33/00* (2006.01)

(52) U.S. Cl. ..... 166/285; 166/177.4

(58) Field of Classification Search ..... 166/285, 166/380, 177.4, 287, 51
See application file for complete search history.

(56) References Cited

U.S. PATENT DOCUMENTS

| | | | | |
|---|---|---|---|---|
| 3,666,009 | A | | 5/1972 | Stone |
| 3,918,523 | A | | 11/1975 | Stuber |
| 3,948,322 | A | | 4/1976 | Baker |
| 4,421,165 | A | | 12/1983 | Szarka |
| 4,474,241 | A | * | 10/1984 | Freeman ..... 166/317 |
| 4,491,178 | A | | 1/1985 | Terrell et al. |
| 4,678,031 | A | | 7/1987 | Blandford et al. |
| 5,024,273 | A | | 6/1991 | Coone et al. |
| 5,109,925 | A | | 5/1992 | Stepp et al. |
| 5,191,932 | A | | 3/1993 | Seefried et al. |
| 5,732,775 | A | | 3/1998 | Hudson et al. |
| 6,578,638 | B2 | | 6/2003 | Guillory et al. |
| 2003/0183386 | A1 | * | 10/2003 | McGregor et al. ..... 166/278 |
| 2003/0183387 | A1 | | 10/2003 | Nguyen et al. |
| 2004/0149418 | A1 | | 8/2004 | Bosma et al. |
| 2005/0087342 | A1 | | 4/2005 | Christensen |
| 2006/0016600 | A1 | | 1/2006 | Badalamenti et al. |

OTHER PUBLICATIONS

Int'l Prelim Report IPRP, Jul. 2, 2009.
Int'l Search Report, May 21, 2008.

* cited by examiner

*Primary Examiner* — Jennifer H Gay
*Assistant Examiner* — Sean Andrish
(74) *Attorney, Agent, or Firm* — Abelman, Frayne & Schwab

(57) ABSTRACT

A method and apparatus for use in stage-cementing an oil well in the region of a lost circulation zone that is proximate an annular space defined by the lower end of an outer casing surrounding an inner casing include a load-bearing annular steel plate of substantial thickness that is positioned on, and maintained stationary relative to the inner casing by supporting and retaining means secured to the inner casing, the outer diameter of the plate being less than the inside diameter of the outer casing so that the plate can be lowered with the inner casing string to the desired location inside of the outer casing and, with a layer of gravel, to provide a seal and support the cement poured into the annulus between the inner and outer casings.

14 Claims, 6 Drawing Sheets

METHOD FOR STAGE-CEMENTING AN OIL WELL

FIELD OF THE INVENTION

The invention relates to the step in the completion of oil wells in which the annular space between an outer casing and a smaller diameter inner casing that extends from the earth's surface is filled with cement.

BACKGROUND OF THE INVENTION

During the initial stage of well drilling through the earth's surface, regions of soil, sand, gravel, loose rock and other unconsolidated materials are encountered. In order to stabilize the casing string that surrounds the production tubing string in this region of unstable subsurface material, an outer casing is lowered with the progressing drill bit. When a more stable formation is reached, the outer casing terminates and an inner casing is then lowered to complete the drilling.

The outer casing may extend to a depth of 1,000 feet/330 m, or more, and is required to provide a barrier for the drilling operation and protect and stabilize the inner casing at the upper layer of the earth's surface where the subsurface is unconsolidated material. Once the drilling has reached a more compacted portion of the formation, the inner casing alone is lowered to the final drilling depth, which may be 4,000 feet/1300 m, or more. The inner casing is stabilized and rigidly secured in place by cementing the annular space between the two casings.

The purpose of a stage-cementing tool is to enable the operator to fill the annulus between the inner and outer surface casing strings with cement slurry when there is a lost circulation zone below the bottom of the outer casing. A lost circulation zone is one in which a cement slurry, drilling mud or other fluids cannot be contained in the well bore and are dissipated and lost in the surrounding formation. This is an undesirable condition and must be rectified.

One conventional stage-cementing tool consists of an inflatable packer element and a diverting tool (DV tool) above the packer. The tool is connected to the inner casing and run in the well to a depth of 50 to 100 ft above the bottom of the outer casing.

A heavy metal object, referred to in the art as a "metal bomb", is dropped in the casing. The bomb falls freely in the drilling fluid in the casing and seats in the stage-cementing tool. Hydraulic pressure is applied from the surface to shift a sleeve and open a port in the stage cementing tool. Drilling fluid is pumped into the port to inflate the packer of the stage tool and form a seal with the outer casing. Higher pressure is then applied to open ports in the diverting tool above the packer. A known volume of cement slurry is pumped down the inner casing. A closing plug is dropped into the casing and drilling fluid is pumped to displace the plug and cement. The cement enters the casing annulus through the open ports in the DV tool above the packer. When the closing plug reaches the stage tool it shifts a sleeve to close the ports in the DV tool. At this time, the casing annulus is full of cement from the stage tool to the surface. The inflated packer forms a seal with the outer casing to prevent the cement slurry from falling into the lost circulation zone below the packer.

The following problems can develop when using a conventional stage-cementing tool:

1. The port to inflate the packer element fails to open. When this occurs, the packer cannot be inflated to form a seal with the outer casing and any cement pumped above the packer will fall down into the lost circulation zone below the stage tool. The casing annulus will remain full of drilling fluid or water.
2. The port in the diverting tool fails to open. When this happens, cement slurry cannot be pumped into the annulus.
3. The inflated packer fails to carry the weight of the cement column above it. The seal between the inflated packer and the outer casing is lost and all the cement slurry falls down into the lost circulation zone below the packer. Again the annulus will remain full of drilling fluid or water.
4. The closing plug fails to close the ports in the DV tool after all the cement has been pumped into the annulus. In this case, the operator has to wait about seven hours until the cement hardens before resuming operations. The waiting time could cost the operator from $7000 to $10,000 at contemporary prices.

Cement baskets are sometimes used instead of stage-cementing tools to place cement in the casing annulus. Cement baskets cannot hold a large load of cement and, therefore, they are normally run to shallow depths of about 300 to 400 feet from the surface. Cement baskets do not form a seal with the outer casing and cement slurry can pass through the arms of the basket. For this reason the cementing job is performed by pumping cement slurry into the annulus in three to four stages to fill the annulus to the surface. After each stage the cement is allowed to harden for 3 to 4 hours before pumping the next stage. This procedure consumes excessive amount of rig time and is therefore costly.

It is therefore an object of the present invention to provide an improved stage-cementing apparatus and method that reliably seals the annular space at the desired depth.

Another object of the invention is to provide a stage-cement tool that can be installed relatively quickly and that is sufficiently robust to support a column of cement slurry that is 1000 feet, or more, in height.

SUMMARY OF THE INVENTION

In accordance with the present invention, a donut-shaped, or annular, steel plate of substantial thickness having an outer diameter that is less than the inner diameter of the outer casing is positioned on a section of the inner casing and lowered into the outer casing as part of the string. This device will be referred to as the stage-cementing metal plate. The casing and plate are lowered to within a predetermined distance, e.g., 50 feet from the down-hole end of the outer casing.

At this point in the drilling process, the annular space is filled with drilling fluid and the region below the end of the outer casing is referred to as a "lost circulation zone". It is therefore necessary for a space to be provided between the outer rim of the plate and the inner wall of the outer casing in order to allow the fluid a passageway to escape as the plate is lowered through the fluid.

Typical casing diameters are as follows: outer casing 18 ⅝inches and inner casing 13 ⅜inches, thereby defining an annular space of about 2 ⅝inches. The plate of the invention is circular in shape with a concentric hole for mounting on the inner casing.

The plate is placed on the coupling of the inner casing string. Stop collars are placed on the inner casing above the plate to prevent vertical movement.

The plate is preferably about 2.5 inches/6.25 cm thick and has an outside diameter slightly smaller than the inside diameter of the outer casing to allow fluids or cement slurry to pass between the outer rim of the plate and the outer casing. The plate is run on the inner casing to the desired depth above the end of the outer casing string. A known volume of cement slurry spacer is pumped from the surface into the annulus between the two casing strings to displace the fluids in the annulus to the lost circulation zone.

A layer of gravel is poured into the annular space and forms a bridge to substantially fill the gap between the edge of the plate and the wall of the outer casing; simultaneously, well cement is poured into the annulus and is prevented from flowing below the annular plate by the layer of gravel. Eventually, the entire annular space from the plate to the surface is filled with the cement slurry and allowed to harden. The plate remains in place supporting the column of hardened cement, which may be 3,000 feet/990 m in depth. The final stage of the installation and cementing is described in detail below.

BRIEF DESCRIPTION OF THE DRAWINGS

The invention will be further described below and with reference to the attached drawings in which.

DETAILED DESCRIPTION OF THE PREFERRED EMBODIMENT

Figure 1:
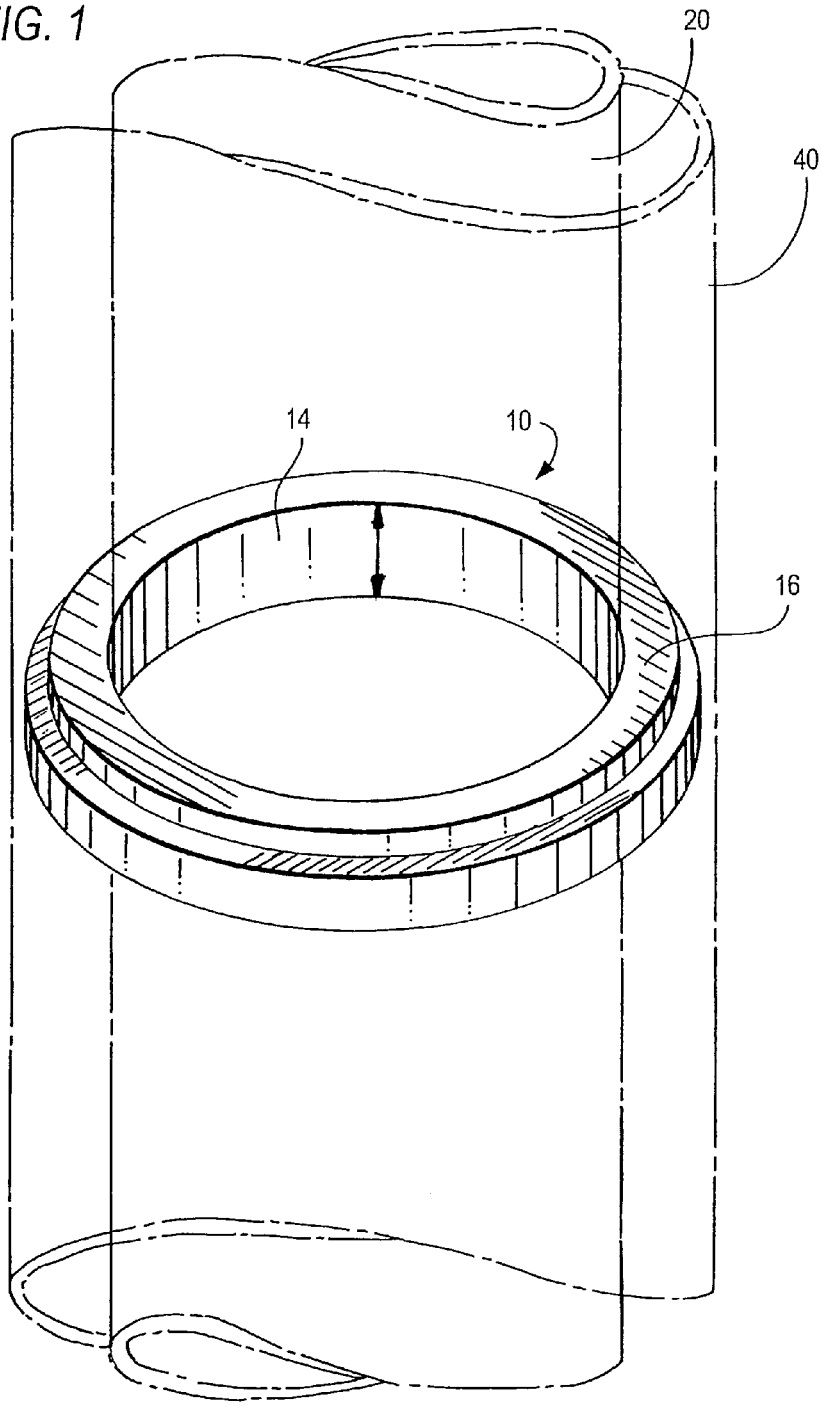
FIG. 1 is a perspective view, partly in phantom, schematically illustrating the positioning of the plate on the inner casing and its relation to the outer casing.

Referring to FIG. 1, there is shown the load-bearing annular steel plate used in the method of the invention in oil well cementing operation in lieu of a stage cementing tool or cement basket to retain cement slurry between two concentric casing strings above a lost circulation zone. The plate 10 is circular in shape with a central circular opening 14 having an inside diameter that is slightly greater than the outside diameter of the inner casing and an outside diameter equal to the drift diameter of the outer casing. The plate is preferably about 2.5 inches/6.25 cm thick and capable of supporting the weight of a cement column of up to 4000 ft/1300 m. Also shown in the embodiment of FIG. 1, the plate is provided with a raised shoulder 16 surrounding the central opening 14.

Figure 2:
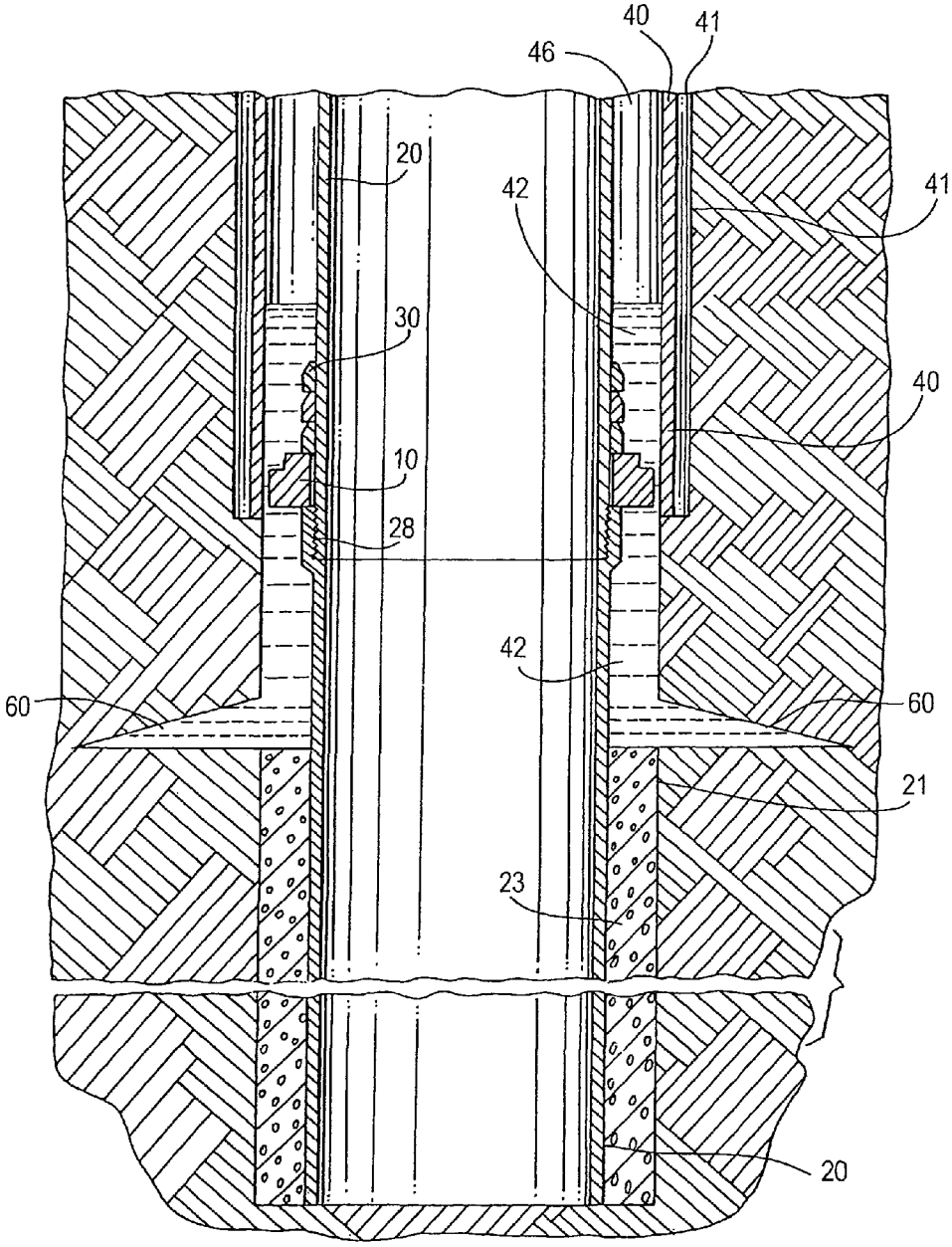
FIG. 2 is a schematic side elevation view, shown partly in section, of the downhole end of the outer casing with the plate of the invention installed on a portion of the inner casing.

Referring now to FIG. 2, the step-by-step procedure for placing cement slurry into the annulus between the two casings strings above a lost circulation zone utilizing the method and apparatus of the present invention will be described.

The plate 10 is placed on the inner casing 20 and installed above the casing coupling 28. Three stop collars 30 are installed on top of the plate 10 to prevent vertical movement and contact the upper surface of shoulder 16. As will be apparent to those of ordinary skill in the art, other means for securing the plate 10 against vertical movement can be employed. The inner casing 20 with the plate 10 securely mounted is lowered to a position so that the plate is about 50 ft/16 m above the bottom of the outer casing. As shown in FIG. 2, the lower end of inner casing 20 is securely positioned in the lower borehole 21 by cement 23, which terminates below the lost circulation zone 60. The lower end of outer casing 40 is positioned in the upper borehole 41, and the annular space 46 between the casings 20 and 40 shown in the illustration partially filled with drilling fluid 42 that is being dissipated into the lost circulation zone 60.

Figure 3:
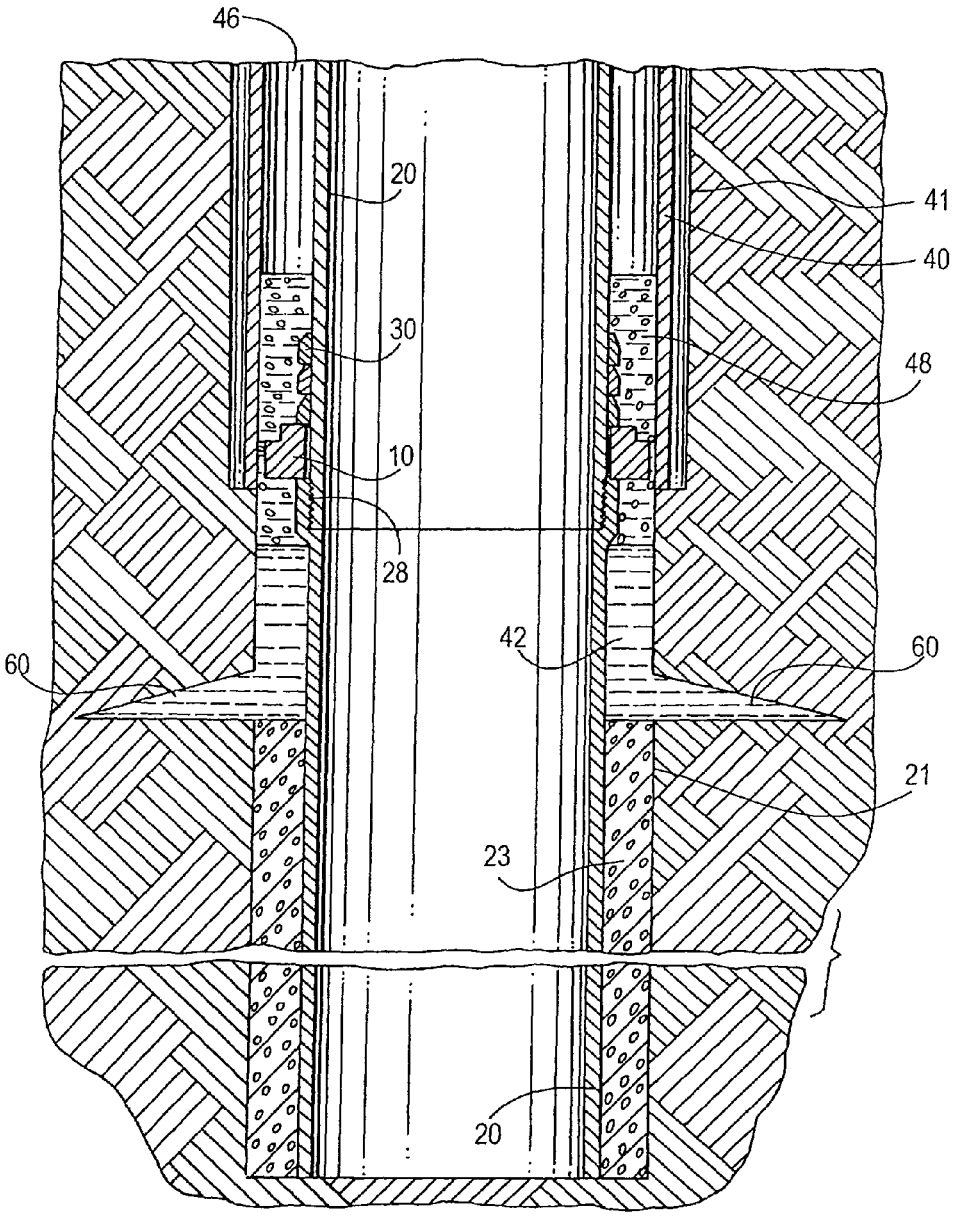
FIG. 3 is a view similar to FIG. 2 showing a spacer of cement slurry in position adjacent the end of the outer casing at the location of the plate.

Referring now to FIG. 3, a known volume of cement slurry 48 is pumped into the annulus 46 between the inner and outer casings at about 5 to 6 barrels per minute to form a spacer and to displace the drilling fluid in the annulus above the plate 10 into the lost circulation zone below the plate.

Figure 4:
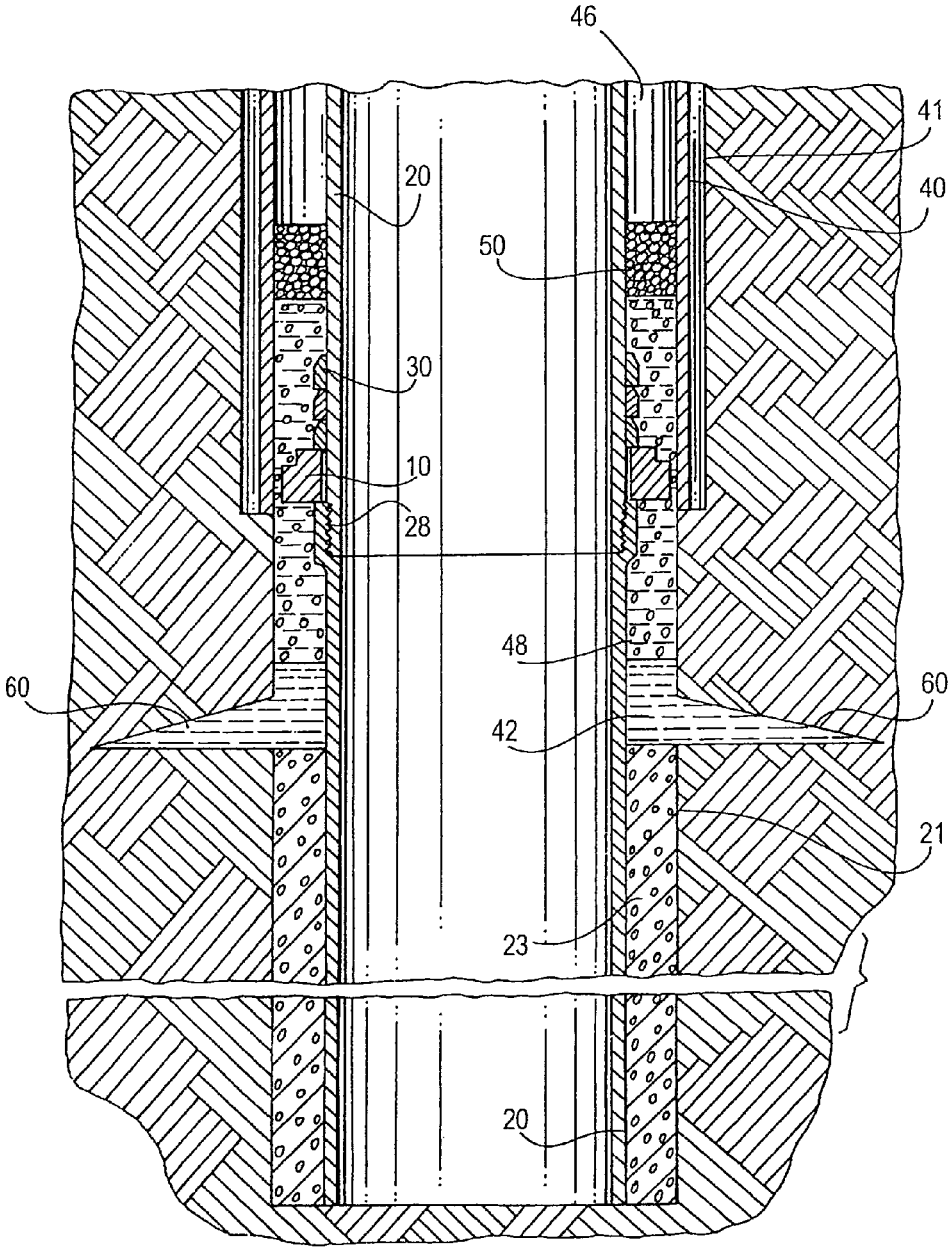
FIG. 4 is a view similar to FIG. 2 showing the introduction of a granular material into the slurry above the plate.

After the cement slurry 48 has been pumped, about one thousand pounds of granular material 50 such as marble chips and gravel of various mesh sizes ranging from 600 microns to 0.75 in/19 mm is poured into the annulus, while also continuing to pump cement slurry into the annulus, as shown schematically in FIG. 4.

Figure 5:
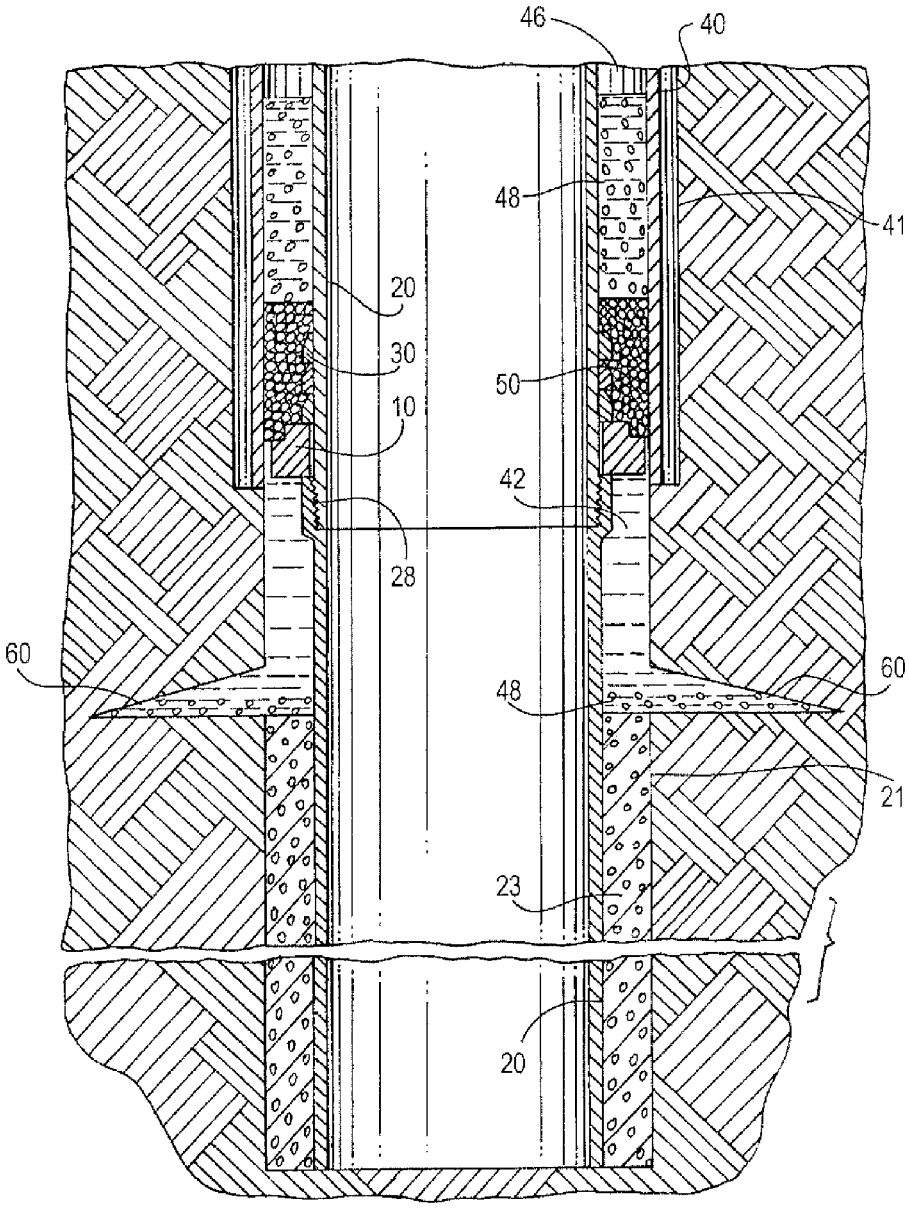
FIG. 5 is a view similar to FIG. 4 showing the granular material in position on upper surface of the plate.

The pumping of cement slurry 48 is continued until the granular material 50 reaches the plate 10 and forms a bridge or seal between the plate and the outer casing 40 blocking the flow of cement slurry around the plate as shown in FIG. 5.

Figure 6:
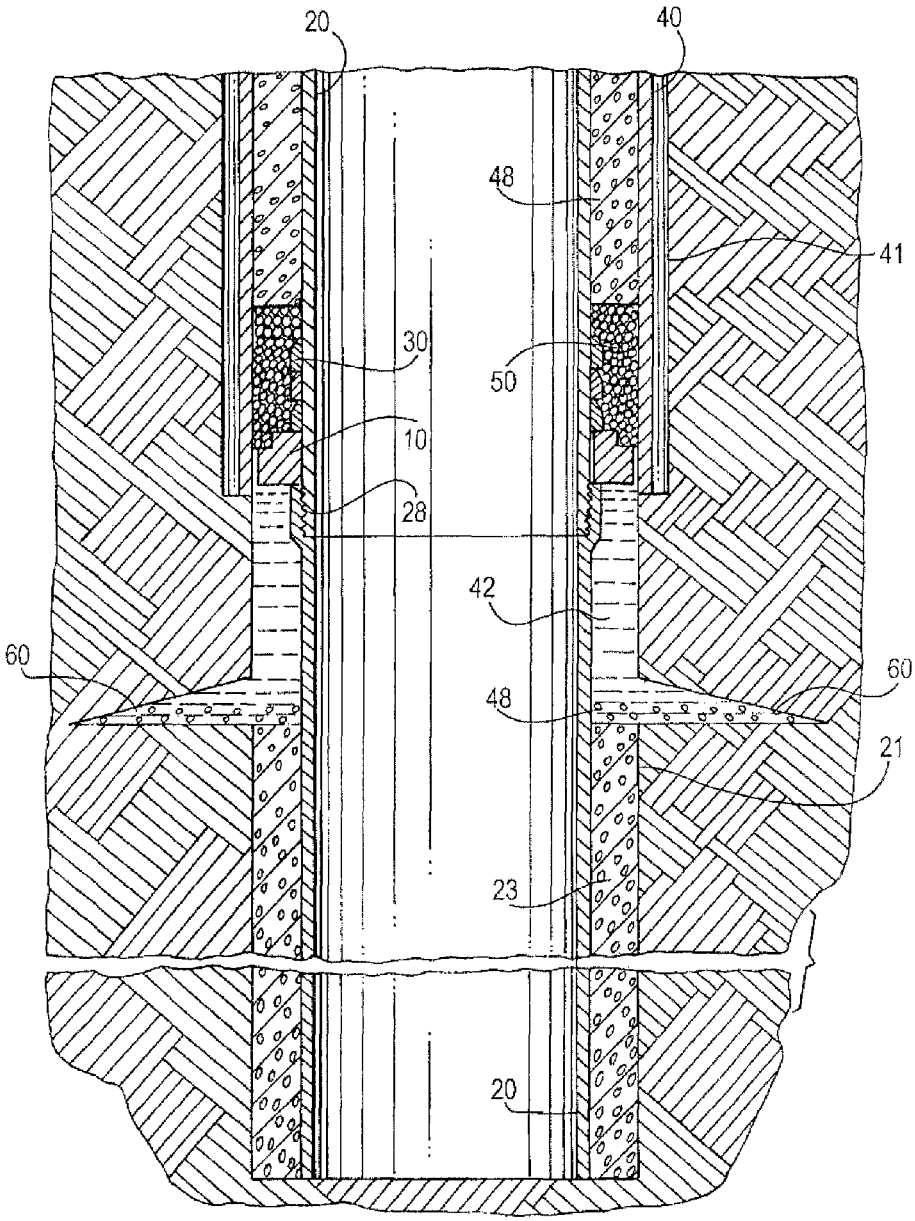
FIG. 6 is a view similar to FIG. 5 showing the annulus above the plate filled with cement.

About 1000 pounds/455 kg of granular material such as marble chips or gravel of different sizes ranging from 600 microns to 0.75 in/19 mm is poured into the annulus while pumping cement. When the granular material reaches the plate, it forms a bridge between the plate and the outer casing preventing the passage of cement slurry around the plate. Pumping of cement slurry is continued until the annulus is filled with the earth's surface as shown in FIG. 6. The annulus 46 should be maintained full of cement while waiting for the cement slurry to harden.

As will be understood from the above description, the stage cementing plate of the present invention has a simple design with no moving parts which makes it more reliable than the conventional stage-cementing tools of the prior art. This apparatus and its method of use meet all of the objectives identified above and constitutes a significant improvement over the devices and methods of the prior art.

As will be apparent to one of ordinary skill in the art from the above description, other embodiments can be derived by obvious modifications and variations of the apparatus and methods disclosed. The scope of the invention is therefore to be determined by the claims that follow.

I claim:

1. A method for completion of a fluid production well extending from a surface of the earth, the well including an outer casing having an inside diameter and a lower end portion terminating below the surface and an adjacent inner casing extending from the surface to a position below the end portion of the outer casing to thereby define an annular space, where the completion includes filling the annular space from proximate a down-hole end of the lower end portion of the outer casing toward the surface of the earth, the method comprising:

a. providing a load-bearing annular steel plate having an upper surface and a central opening for receiving a section of the inner casing, and having an outer diameter that is less than the inside diameter of the outer casing to define an open space to permit the annular steel plate to pass through the outer casing;

b. supporting and securing the plate on the section of the inner casing in close-fitting relation;

c. lowering the annular steel plate and the inner casing to a position inside of the lower end portion of the outer casing;

d. placing a predetermined volume of gravel on the upper surface of the annular steel plate to thereby substantially seal the open space between a periphery of the annular steel plate and an adjacent interior surface of the outer casing; and e. pouring a cement slurry on to the annular steel plate to fill the annular space above the annular steel plate and up toward the surface of the earth.

2. The method of claim 1 which includes placing a predetermined volume of the cement slurry in the annulus to displace any fluids to a lost circulation zone proximate the fluid production well prior to placement of the gravel.

3. The method of claim 1 which includes securing at least one stop collar to the inner casing adjacent the upper surface of the annular steel plate to thereby restrain the movement of the annular steel plate relative to the inner casing.

4. The method of claim 1 which includes lowering the annular steel plate to a position that is about sixty feet or nineteen meters above the lower end portion of the outer casing.

5. The method of claim 1, wherein the annular steel plate is provided with a raised shoulder surrounding the central opening, the raised shoulder being configured to extend upward towards the surface of the earth when positioned in the fluid production well.

6. The method of claim 1 in which a granular material is introduced into the annular space with the cement slurry.

7. The method of claim 6 in which the granular material includes marble chips.

8. The method of claim 7 in which the granular material has a size in a range of 600 microns to 0.75 inch or 19 millimeters.

9. The method of claim 1 in which the plate is supported by an upper surface of an inner casing coupling.

10. The method of claim 9 in which the lower surface of the annular steel plate is placed in direct contact with an upper surface of the inner casing coupling.

11. The method of claim 1, wherein the step of lowering the annular steel plate includes lowering the annular steel plate to a depth above a lost circulation zone of the well.

12. The method of claim 1, wherein the predetermined volume of gravel prevents flow of the cement slurry through the open space between the periphery of the annular steel plate and the adjacent interior surface of the outer casing.

13. The method of claim 1, wherein the step of pouring the cement slurry comprises pouring the cement slurry on to the upper surface of the gravel supported by the annular steel plate to fill the annular space above the annular steel plate and up toward the surface of the earth.

14. The method of claim 1, wherein prior to the step of placing the predetermined volume of gravel on the upper surface of the annular steel plate, the method includes the step of pouring an initial volume of cement slurry into the annular space to displace drilling fluids above the annular steel plate into a lost circulation zone which is formed in the fluid production well below the annular steel plate.

* * * * *